US005203506A

United States Patent [19]

Gross et al.

[11] Patent Number: 5,203,506

[45] Date of Patent: Apr. 20, 1993

[54] LIQUID PUMP AND NEBULIZER CONSTRUCTED THEREWITH

[75] Inventors: Joseph Gross, Moshav Mazor; Shlomo Zucker, Mihmoret, both of Israel

[73] Assignee: Product Development (Z.G.S.) Ltd., Petah Jikja, Israel

[21] Appl. No.: 808,345

[22] Filed: Dec. 16, 1991

[51] Int. Cl.[5] ..... B05B 3/02

[52] U.S. Cl. ..... 239/224; 239/223; 239/338; 128/200.14

[58] Field of Search ..... 239/219, 223, 224, 338; 128/200.14

[56] References Cited

U.S. PATENT DOCUMENTS 4,221,332 9/1980 Bals ..... 239/223
4,553,700 11/1985 Snyder et al. ..... 239/223
4,627,430 12/1986 Klimt ..... 239/338

FOREIGN PATENT DOCUMENTS 1026736 7/1985 U.S.S.R. ..... 239/223
1533767 1/1990 U.S.S.R. ..... 239/223

*Primary Examiner*—Andres Kashnikow
*Assistant Examiner*—Lesley D. Morris
*Attorney, Agent, or Firm*—Benjamin J. Barish

[57] ABSTRACT

A liquid pumping device, particularly useful as nebulizer, includes a receptacle for receiving a quantity of a liquid to be pumped, a hollow conical tube having a small-diameter end located to be immersed in the liquid to be pumped, and a larger-diameter end located above the liquid to be pumped, and a drive for rotating the hollow conical tube about its longitudinal axis to pump by centrifugal force liquid therethrough from its small-diameter end to its larger-diameter end. When the device is used as a nebulizer the hollow conical tube includes a plurality of holes at vertically spaced locations, and a plurality of annular discs secured to the outer surface of the conical tube each underlying one or more of the holes.

14 Claims, 2 Drawing Sheets

LIQUID PUMP AND NEBULIZER CONSTRUCTED THEREWITH

FIELD AND BACKGROUND OF THE INVENTION

The present invention relates to a liquid pump for pumping a liquid from a low elevation to a higher elevation. The invention is particularly useful when constructed as a nebulizer for nebulizing or atomizing a liquid, and is therefore described below with respect to this application.

Nebulizers are widely used in medical applications, particularly as inhalators for inhaling vapours which may include a drug. However, for most effective inhalation, the vapour (with or without the drug) must be atomized into very fine droplets of a few microns in diameter. The nebulizers now commonly used for such medical applications are generally based on atomizing the liquid by an ultrasonic device or by a device which produces a high velocity flow across or through a nozzle. However, such known nebulizers are generally expensive to produce and bulky to carry.

OBJECTS AND BRIEF SUMMARY OF THE INVENTION

An object of the present invention is to provide a liquid pumping device, and particularly a nebulizer, which may be used for medical applications and which can be produced in a simple, inexpensive, and compact form.

According to the present invention, there is provided a liquid pumping device comprising: a receptacle for receiving a quantity of liquid to be pumped; a hollow conical tube having a small-diameter end located to be immersed in the liquid to be pumped, and a larger-diameter end located above the liquid to be pumped; and a drive for rotating the hollow conical tube about its longitudinal axis to pump by centrifugal force liquid therethrough from its small-diameter end to its larger-diameter end.

According to further features in the preferred embodiment of the invention described below, the larger diameter end of the hollow conical tube includes a passage radially through its wall through which the liquid flows by centrifugal force.

According to still further features in the described preferred embodiment, the device further includes an annular disc secured to the outer surface of the hollow conical tube to rotate therewith, the annular disc being located at the upper end of the hollow conical tube under the passage so as to receive the liquid flowing therethrough and to eject it outwardly in atomized form by centrifugal force. More particularly, in the described embodiment the hollow conical tube includes a plurality of the passages at vertically spaced locations, and the device includes a plurality of the annular discs secured to the outer surface of the hollow conical tube each underlying at least one of the passages.

When the liquid pumping device is to be used as a nebulizer, preferably each of the annular discs is formed with an annular rib around the periphery of its upper surface to enhance the atomization of the liquid ejected outwardly by centrifugal force. In the described preferred embodiment, each of the annular ribs is formed with a sharpened outer edge.

According to a still further feature in the described preferred embodiment, the device also includes a rod assembly of closely-spaced, vertically-extending rods arranged in a circular array around the discs to further enhance the atomization of the liquid.

As will be described more particularly below, a nebulizer constructed in accordance with the foregoing features is capable of atomizing the liquid to droplets of a very fine size (of the order of several microns) and may be embodied in a small, compact and inexpensive construction.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
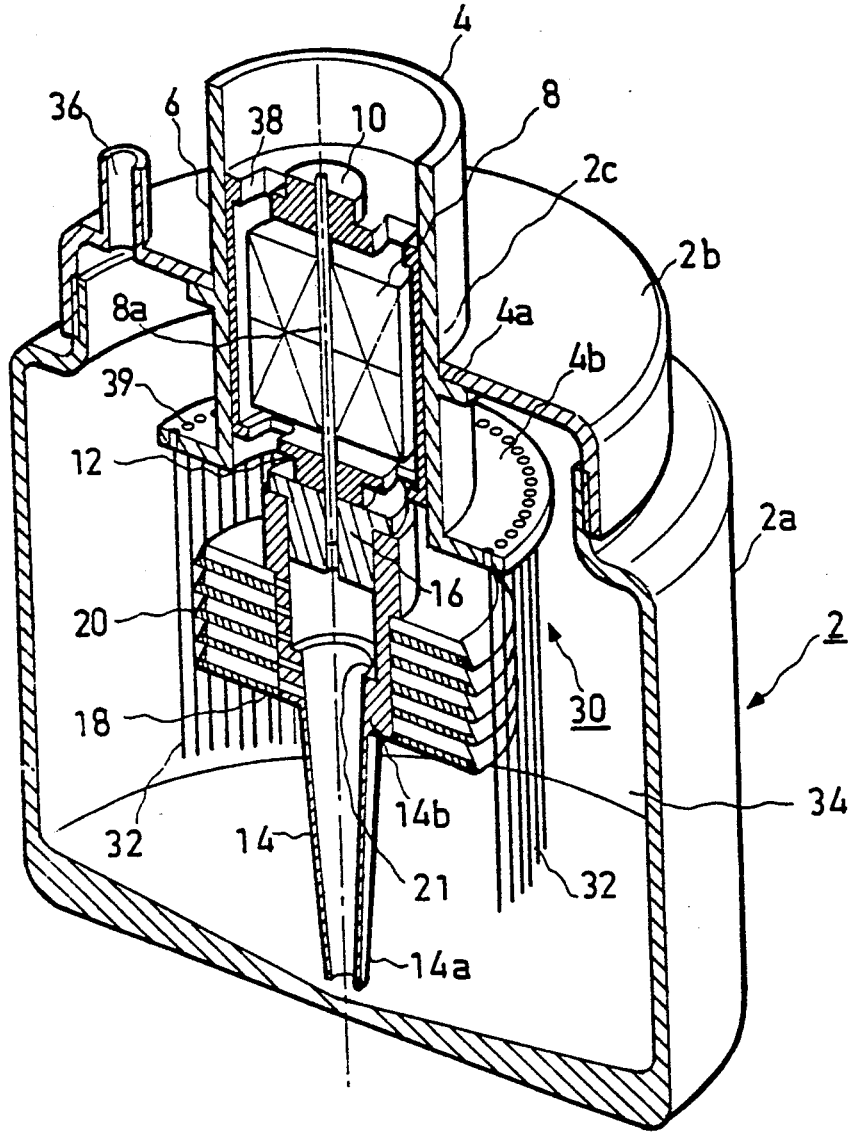
FIG. 1 is a three-dimensional view, parts being broken away to show internal structure, of one form of nebulizer constructed in accordance with the present invention.

The drawings illustrate a liquid pumping device constructed in the form of a nebulizer for atomizing a liquid into very small droplets for medical purposes. The liquid atomized may be water, with or without a drug, for purposes of inhalation.

The illustrated nebulizer comprises a housing, generally designated 2, which also serves as a receptacle for receiving the liquid to be atomized. Housing 2 includes a main section **2*a* open at the top, and a cover 2*b*** which is removably attached to the upper end of the housing for purposes of introducing the liquid to be atomized.

Cover **2*b* of the housing is formed with a large central opening 2*c* receiving a tube 4 fixed within the opening. For this purpose, tube 4 is formed with an annular flange 4*a* engageable with the undersurface of cover 2*b* and fixed thereto by welding, fasteners, or in any other suitable manner. Mounted within tube 4 is a sleeve 6 housing a rotary electric motor 8. Motor 8 includes a rotary shaft 8*a* passing through bearings 10, 12 at the opposite ends of sleeve 6. The lower end of the rotary shaft 8*a* is coupled to a hollow conical tube 14 which extends vertically in the main housing section 2*a*, with the small, diameter end 14*a* of the tube at the bottom and spaced slightly above the bottom wall of the main housing section 2*a* for immersion in the liquid to be introduced into the housing. The upper, larger-diameter end of the hollow conical tube 14 is of increased wall thickness, as shown at 14*b* and is closed by a plug 16 coupled to the rotary shaft 8*a* of the electric motor 8, such that the conical tube 14** is rotated with the motor.

The upper, larger-diameter end **14*b* of the hollow tube wall 14 is pierced by a plurality of radial openings 18 at vertically spaced locations. A plurality of annular discs 20 are secured to the outer face of the tube upper end 14*b* in mutually spaced relation such that each disc directly underlies one or more of the openings 18. The inner surface of the upper tube end 14*b* is increased in diameter to define an annular ledge 21, such that some of the openings 18** are below the ledge, whereas other openings are above the ledge.

As will be described more particularly below, the rotation of the hollow conical tube 14 about its longitudinal axis pumps the liquid from its lower end 14*a* along the inner surface of the tube to the openings 18 at the upper end of the tube. Openings 18 serve as passages for the liquid, which flows therethrough and is ejected outwardly by centrifugal force onto the upper surfaces of the discs 20.

Figure 2:
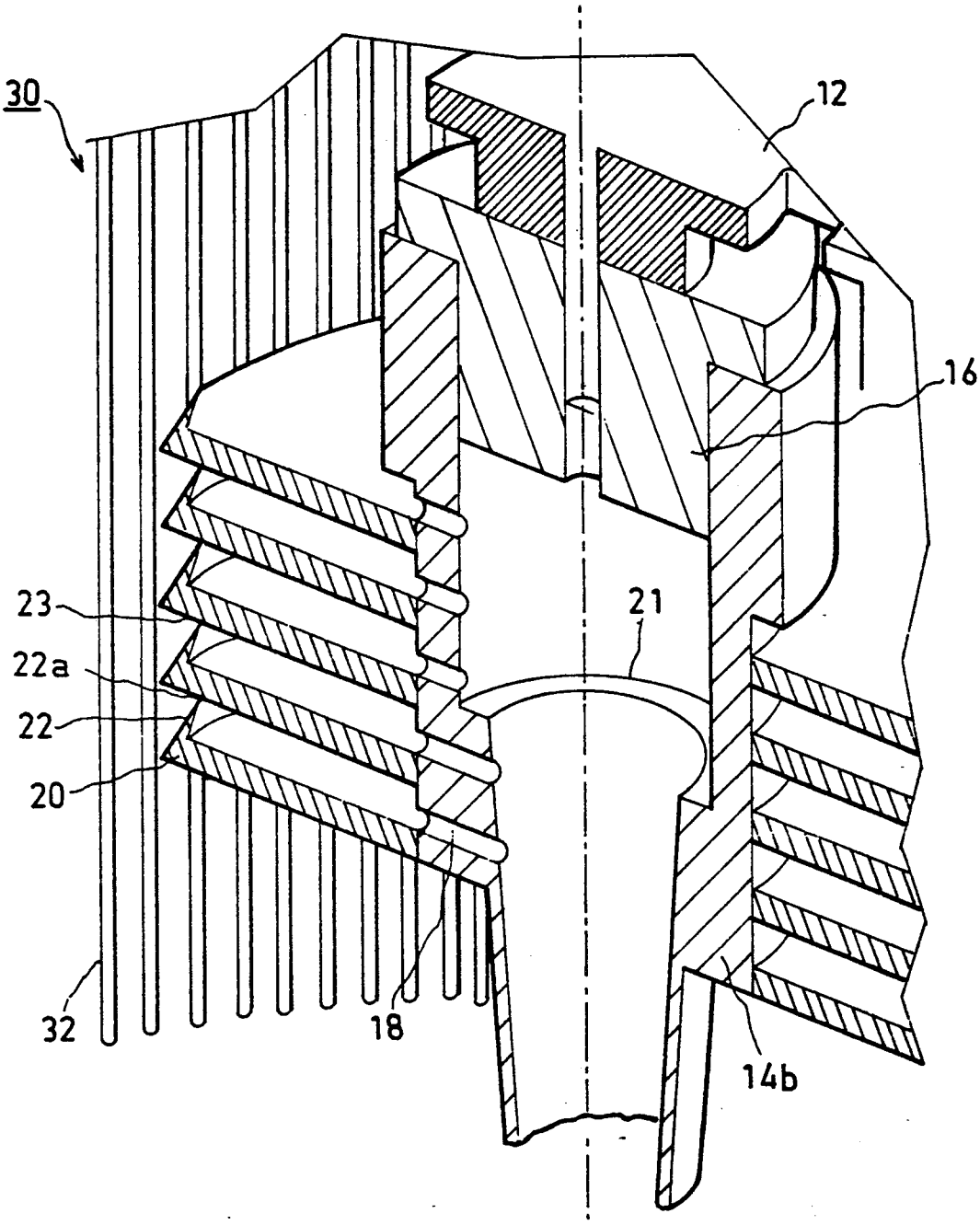
FIG. 2 is an enlarged three-dimensional view more particularly illustrating the structure of the nebulizer of FIG. 1.

As shown particularly in FIG. 2, the upper surfaces of the discs 20 are formed with annular ribs 22 having sharpened outer edges 22*a*. The sharpened edge 22*a* of each disc has a cross-sectional area decreasing toward the under face of the overlying disc and is closely spaced to the undersurface of the overlying disc so as to define a very small annular passage 23 between the rib of one disc and the overlying disc. The liquid is ejected outwardly through these passages 23 by centrifugal force during the rotation of the conical tube 14. The liquid thus flows through the openings 18, along the upper faces of the discs 20, and through the small annular passages 23 between the outer sharpened edges 22*a* of one disc and the flat underlying face of the overlying disc, and is atomized as it is ejected outwardly through the annular passages by centrifugal force.

The atomization of the liquid is further enhanced by a rod assembly, generally designated 30, comprised of a plurality of closely-spaced, vertically-extending rods 32 arranged in a circular array around the discs 20. The rods 32 are mounted in an annular flange 4*b* integrally formed at the lower end of tube 4 received within the cover 2*b* of the housing 2. The so-atomized liquid ejected by centrifugal force through the spaces between the rods 32 is received within the annular space 34 between the rods 32 and the inner face of housing section 2*a* and is outletted through the housing via an outlet 36 formed in the cover 2*b*. The opposite ends of sleeve 6 receiving the electric motor 8 are formed with air passages, as shown at 38 and 39, for permitting an inflow of air into housing 2 with the outflow of the atomized liquid via the outlet 36.

The manner of using and operating the illustrated nebulizer will be apparent from the above description. Thus, liquid may be introduced into the interior of housing section 2*a* by removing cover 2*b*. Sufficient liquid should be introduced to immerse at least the bottom end 14*a* of the hollow conical tube 14 within housing 2.

When motor 8 is energized, it rotates the hollow conical tube 14 about its longitudinal axis. This forces the liquid to move by centrifugal force along the inner surface of the hollow conical tube to the openings 18 at the upper end 14*b* of the conical tube. The rotation of the tube also causes the liquid to flow through the radial passages 18 outwardly onto the upper faces of the discs 20 and through the small annular passages 23 between the outer sharpened edge 22*a* of the disc ribs 22. Ledge 21 on the inner surface of the hollow conical tube 14 causes a small pool of the liquid to be formed for feeding the higher openings 18 and the higher discs 20.

The liquid is atomized as it is ejected outwardly of the rotating discs 20 by centrifugal force, and is further atomized by the closely-spaced vertically-extending rods 32. The larger droplets of the so-atomized liquid are thrust outwardly with greater velocity than the smaller droplets and therefore tend to reach the inner surface of the container 2 and to flow back into the bottom of the container. The smaller droplets tend to flow out through the outlet 36. The droplets thus produced by the illustrated nebulizer are of very fine size.

In the example illustrated in the drawings, the hollow conical tube 14 may be 50 mm in length up to the uppermost disc 20; the inner diameter of the lower end 14*a* may be about 3.5 mm; and the upper diameter at the topmost disc may be about 10 mm. The openings 18 may be of a diameter of up to 5 mm, preferably about 1 mm; the discs may have an outer diameter of 5 to 100 mm, preferably about 35 mm; the spacing between the outer sharpened edges 22*a* of the annular ribs 22 of one disc and the adjacent flat face of the overlying disc may be from 0.1–2.0 mm, preferably about 1 mm; the rods 32 may be of 0.5 to 5 mm, preferably about 0.8 mm diameter; the spacing between the rods may be about 1 to 5 mm, preferably about 2 mm; and the hollow conical tube 14 may be rotated at a speed of 1,000–20,000 RPM, preferably 10,000 RPM. It has been found that a construction of the above preferred example nebulizes the liquid into droplets substantially no greater than a few (0.5 to 6) microns, which makes the nebulizer particularly suitable as an inhalator for medical purposes.

Figure 3:
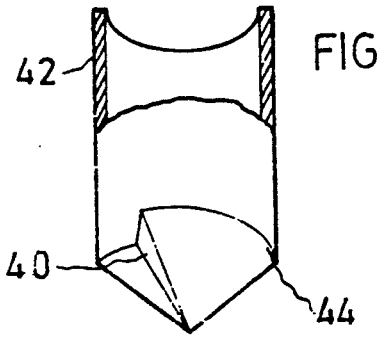
FIG. 3 illustrates a cap which may be applied to the lower end of the device to increase the liquid discharge rate.

In some applications, it may be desirable to increase the rate of nebulization. This may be done by providing the small-diameter, bottom end of the hollow conical tube 14 with a shaped blade formation for increasing the inflow of the water into the tube upon its rotation by the motor 8. FIG. 3 illustrates such a blade formation, shown at 40, formed at the end of a cap 42 which is removably applied to the bottom of the conical tube 14. Thus, as the tube 14 is rotated, cap 42 rotates with it to increase the inflow of the water via opening 44 of the cap into the tube upon its rotation by motor 8. By providing the blade formation 40 in the form of a removable cap, the desired inflow rate can be varied as desired, e.g., by providing a plurality of such caps 42 each with a different blade formation 40, and selecting the appropriate cap according to the desired inflow rate.

While the invention has been described with respect to one preferred embodiment, it will be appreciated that this is set forth merely for purposes of example, and that many other variations, modifications and applications of the invention may be made.

What is claimed is:

1. A liquid pumping device, comprising:

a receptacle for receiving a quantity of a liquid to be pumped;

a hollow conical tube having a small-diameter end located to be immersed in the liquid to be pumped, and a larger-diameter end located above the liquid to be pumped, said larger-diameter end being formed with a plurality of radially-extending passages through which the liquid is pumped by centrifugal force when the hollow conical tube is rotated;

a plurality of annular discs secured to the outer surface of said hollow conical tube to rotate therewith, each of said annular discs being located at the larger-diameter end of the hollow conical tube under one of said passages so as to receive the liquid flowing therethrough and to eject it outwardly in atomized form by centrifugal force;

each of said annular discs being formed with an annular rib around the outer periphery of its upper surface;

each of said annular ribs being formed with a sharpened outer edge having a cross-sectional area decreasing toward the under face of the overlying disc and closely spaced thereto to define a very small annular passage between the rib of one disc and the overlying disc;

and a drive for rotating said hollow conical tube about its longitudinal axis to pump by centrifugal force liquid therethrough from its small-diameter end to its larger-diameter end.

2. The device according to claim 1, further including a rod assembly of closely-spaced, vertically-extending rods arranged in a circular array around said discs to enhance the atomization of the liquid.

3. The device according to claim 2, wherein said receptacle includes a side wall enclosing, but spaced from, said rod assembly, and an outlet communicating with the space between said side wall and rod assembly.

4. The device according to claim 4, wherein the inner surface of the upper end of said tube above said annular ledge is of cylindrical configuration.

5. The device according to claim 1, wherein said hollow conical tube is reduced in thickness at its upper end to define an inner annular ledge for accumulating a small quantity of the liquid, which ledge communicates with the upper passages formed through the tube.

6. The device according to claim 1, wherein said small-diameter end of the hollow conical tube includes a shaped blade formation for increasing the inflow of the water into the tube upon its rotation by said drive.

7. The device according to claim 6, wherein said shaped blade formation is carried by a cap removably applied to said small-diameter end of the hollow conical tube.

8. A nebulizer, comprising:

a receptacle for receiving a quantity of liquid to be pumped;

a hollow conical tube having a small-diameter end located to be immersed in the liquid to be nebulized, and a larger-diameter end located above the liquid to be nebulized;

the larger-diameter end of the hollow conical tube being formed with a plurality of radially-extending passages at different elevations thereof through which the liquid is pumped by centrifugal force when the hollow conical tube is rotated;

said small-diameter end of the hollow conical tube including a shaped blade formation for increasing the inflow of the water into the tube upon its rotation;

and a drive for rotating said hollow conical tube about its longitudinal axis.

9. The nebulizer according to claim 8, wherein the device further includes a plurality of annular discs secured in mutually spaced relation to the outer surface of said hollow conical tube at the larger-diameter end thereof, each of said discs being located under at least one of said passages so as to receive the liquid flowing therethrough and to eject it outwardly in atomized form by centrifugal force.

10. The nebulizer according to claim 9, wherein each of said annular discs is formed with an annular rib around the outer periphery of its upper surface.

11. The nebulizer according to claim 10, wherein each of said annular ribs is formed with a sharpened outer edge.

12. The nebulizer according to claim 10, further including a rod assembly of closely-spaced, vertically-extending rods arranged in a circular array around said discs to enhance the atomization of the liquid.

13. The nebulizer according to claim 12, wherein said receptacle includes a side wall enclosing, but spaced from, said rod assembly, and an outlet communicating with the space between said side wall and rod assembly.

14. The nebulizer according to claim 8, wherein said shaped blade formation is carried by a cap removably applied to said small-diameter end of the hollow conical tube.

* * * * *